US008800218B2

(12) United States Patent
Robak

(10) Patent No.: US 8,800,218 B2
(45) Date of Patent: Aug. 12, 2014

(54) INSULATING CONSTRUCTION PANELS, SYSTEMS AND METHODS

(76) Inventor: Edward Robak, Dix Hills, NY (US)

( * ) Notice: Subject to any disclaimer, the term of this patent is extended or adjusted under 35 U.S.C. 154(b) by 0 days.

(21) Appl. No.: 13/480,382

(22) Filed: May 24, 2012

(65) Prior Publication Data

US 2013/0000222 A1 Jan. 3, 2013

Related U.S. Application Data

(60) Provisional application No. 61/519,511, filed on May 24, 2011.

(51) Int. Cl.
*E04B 1/00* (2006.01)
*E04C 2/52* (2006.01)
*E04B 1/70* (2006.01)

(52) U.S. Cl.
USPC ..... 52/105; 52/220.3; 52/220.1; 52/220.2; 52/302.3; 52/302.1

(58) Field of Classification Search
USPC ..... 52/105, 220.3, 220.1, 220.2, 302.3, 52/302.1
See application file for complete search history.

(56) References Cited

U.S. PATENT DOCUMENTS

| | | | | |
|---|---|---|---|---|
| 738,643 | A * | 9/1903 | Van Camp | 52/284 |
| 4,884,382 | A | 12/1989 | Horobin | |
| 5,428,933 | A | 7/1995 | Philippe | |
| 5,465,542 | A * | 11/1995 | Terry | 52/309.7 |
| 5,566,521 | A * | 10/1996 | Andrews et al. | 52/606 |
| 5,625,989 | A | 5/1997 | Brubaker et al. | |
| 5,704,180 | A | 1/1998 | Boeck | |
| 5,729,936 | A * | 3/1998 | Maxwell | 52/220.2 |
| 6,318,041 | B1 * | 11/2001 | Stanley | 52/505 |
| 6,526,710 | B1 * | 3/2003 | Killen | 52/220.1 |
| 6,860,073 | B2 * | 3/2005 | Chien | 52/220.1 |
| 7,739,846 | B2 | 6/2010 | Garrett | |
| 7,743,565 | B2 * | 6/2010 | Pyo | 52/220.2 |
| 7,762,033 | B2 * | 7/2010 | Scott et al. | 52/425 |
| 7,805,906 | B2 | 10/2010 | Garrett | |
| 7,874,112 | B2 | 1/2011 | Kovatch et al. | |
| 2009/0007509 | A1 * | 1/2009 | Jordan et al. | 52/302.1 |

* cited by examiner

*Primary Examiner* — Mark Wendell
(74) *Attorney, Agent, or Firm* — Law Office of Richard F. Jaworski PC

(57) ABSTRACT

An insulating construction panel having a top end, a bottom end, a first end, a second end, a front side and a rear side, the panel for constructing a single or multi-cavity concrete form. The panel includes regularly spaced coplanar passages extending through the panel from the top end toward the bottom end and at least one angular passage perpendicularly intersecting each coplanar passage at the top end and bottom end of the panel and extending toward and through at least a portion of the back end of the panel.

18 Claims, 22 Drawing Sheets

INSULATING CONSTRUCTION PANELS, SYSTEMS AND METHODS

REFERENCE TO RELATED APPLICATION

The present application is based on and claims benefit of Provisional Application Ser. No. 61/519,511 filed May 24, 2011 and entitled "INSULATING CONSTRUCTION PANELS, SYSTEMS AND METHODS," the entire contents of which are herein incorporated by reference.

BACKGROUND

1. Technical Field

The present disclosure relates to construction panels and, in particular, to insulating constructions panels, systems and methods.

2. Description of the Background Art

Various construction techniques have been devised. Many of these techniques are directed at lowering the overall cost of construction by reducing the cost of materials, time required and/or the amount of labor required. In addition, with the recent push towards energy independence and becoming a "Green" society, various types of new or modified construction techniques have been directed at making structures (for example, homes) more energy efficient. Construction techniques have also been developed to make recycling of materials more practical and efficient.

One area of concern involves the construction of the foundation (or wall) of a structure. The function of a foundation is to support the weight of the structure and to provide a level surface to build on. The foundation will also often form the wall of a portion of the structure such as a basement wall. Foundations can be built from various types of materials including stone, brick, concrete block, treated lumber or poured concrete. Of these, poured concrete is one of the most widely used materials.

Poured concrete foundations have been built using various types of methods and can include poured slabs as well as raised perimeter foundations. One of the oldest and most basic methods of forming a poured concrete raised perimeter foundation is to use wooden forms. This method involves placing two parallel wooden structures spaced a predetermined distance from each other along the footprint or perimeter of the structure to be constructed. Concrete is a material that is very strong in compression but is relatively weak in tension. Accordingly a reinforcing bar, also known as rebar, is normally used in this type of construction and is cast into the concrete to carry the tensile loads. The rebar is arranged at predetermined positions within the parallel wooden structures and held in place with wood and/or metal ties. The concrete is then poured into the space between the wooden structures and allowed to set. After setting, the wooden structures are removed, leaving the poured concrete foundation upon which the structure can be built.

It will be appreciated that the process of setting up and breaking down the wooden structure and arranging the rebar is vary time consuming and labor intensive.

A variety of insulating concrete form systems, known as insulated concrete forms or blocks, have been developed for casting a concrete foundation or wall. Often, these systems include interlocking blocks that are formed from a pair of opposed foam panels connected together in a spaced, parallel relationship by a plurality of tie members to define a concrete receiving cavity. The blocks are aligned and stacked to define a wall, and concrete is poured into the concrete receiving cavities. The blocks are maintained in place after the concrete hardens to insulate the concrete, provide a sound barrier, insulation, and serve as a backing for finishing material.

While many insulating concrete form systems have met with some success, numerous problems exist with these systems. For example, problems are encountered while fitting the panels or blocks together, pouring the concrete into the forms, difficulty of utility installation and attachment of finishing materials to the insulated concrete wall. There are also issues with the transportation and storage of the preassembled types of blocks. Many of these systems require specially moulded corner blocks. There are also issues involved with manufacturing these form systems. For example, these form systems often require costly manufacturing processes for providing connectors or tie members embedded in the inner faces of the insulating panels or blocks.

Accordingly, there is a need for an improved insulating concrete form that overcomes the problems experienced with the previously known forms.

SUMMARY

This application describes (in the form of methodologies, apparatuses, and systems) for insulating construction panels, systems and methods.

An insulating construction panel having a top end, a bottom end, a first end, a second end, a front side and a rear side, the panel for constructing a single or multi-cavity concrete form. The panel comprises regularly spaced coplanar passages extending through the panel from the top end toward the bottom end and at least one angular passage perpendicularly intersecting each coplanar passage at the top end and bottom end of the panel and extending toward and through at least a portion of the back end of the panel.

A tie for interlocking two or more construction panels to construct a single or multi-cavity concrete form. The tie comprises two or more elongated plates, the elongated plates including horizontal center marks on an outside face of the elongated plates, two or more angular connectors, perpendicularly intersecting the two or more elongated plates and at least one spacer joining the angular connectors.

An insulating construction panel system comprising a plurality of interlocking panels, a plurality of ties including portions insertable into slots provided in the plurality of interlocking panels, the ties maintaining the panels a predetermined distance apart to form a space into which concrete can be poured. The portions of the ties insertable into the slots provide a suitable structure into which connectors can be driven and secured when attaching finishing materials to a face of the panels.

BRIEF DESCRIPTION OF THE DRAWINGS

A more complete appreciation of the present disclosure and many of the attendant advantages thereof will be readily obtained as the same becomes better understood by reference to the following detailed description when considered in connection with the accompanying drawings, wherein.

DETAILED DESCRIPTION

The following exemplary embodiments are set forth to aid in an understanding of the subject matter of this disclosure, but are not intended, and may not be construed, to limit in any way the subject matter or claims which follow thereafter. Therefore, while specific terminology is employed for the sake of clarity in describing some exemplary embodiments, the present disclosure is not intended to be limited to the specific terminology so selected, and it is to be understood that each specific element includes all technical equivalents which operate in a similar manner.

Figure 17:
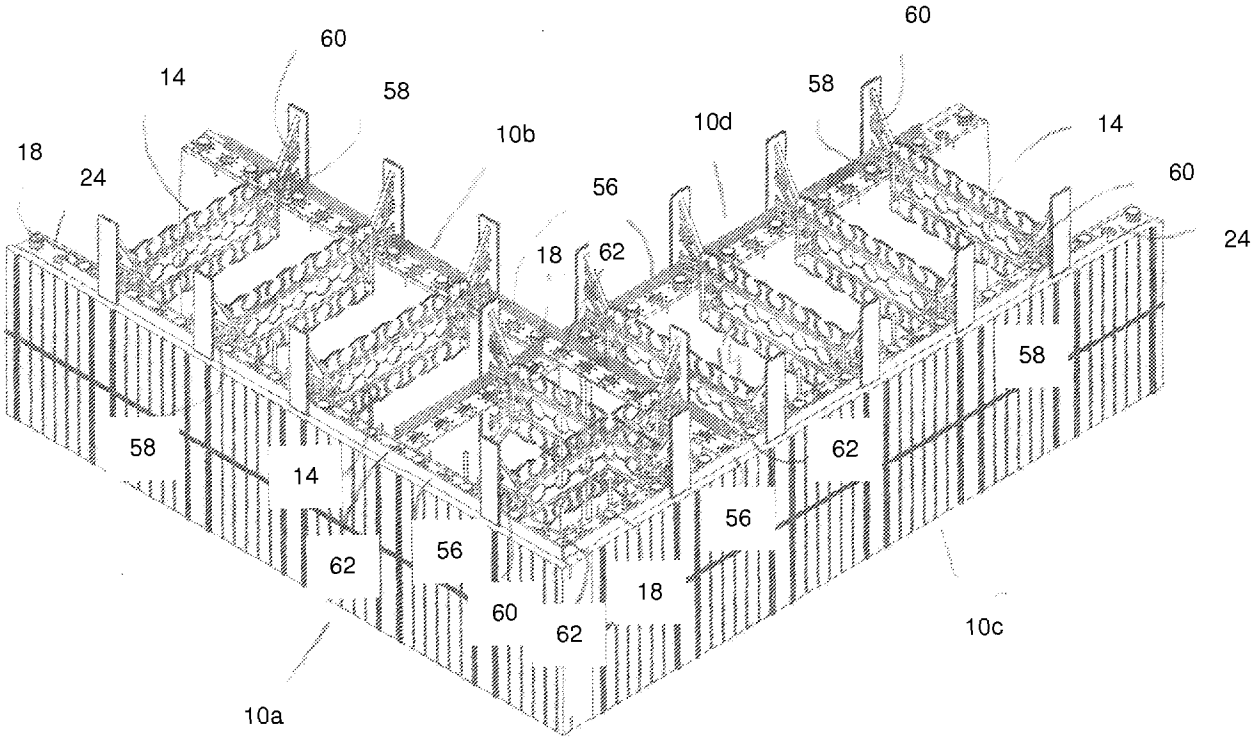
FIG. 17 is a perspective view of an assembled corner form according to an embodiment of the present disclosure, showing construction panels, ties and T-shaped moldings.

An insulating panel construction system according to an embodiment of the present disclosure is shown in FIG. 17. The system has several components including interlocking panels 10 (e.g., 10*a*-10*d*) forming sides of the concrete form. Insertable ties 14 are provided for maintaining the panels a predetermined distance apart forming a space for concrete to be poured. T-shaped moldings 56 are provided for tying a plurality of the interlocking panels together at corners of the concrete form.

When the insulating panel construction system according to embodiments of the present disclosure is erected, concrete is poured into the cavity between the panels. After the concrete sets, the panel construction system is maintained in place. The panels insulate the concrete, provide a sound barrier, insulation, and serve as a backing for finishing material.

The individual components forming the insulating panel construction system according to embodiments of the present disclosure will be described, followed by a description of how the individual components fit together to provide a superior construction system.

Figure 1:
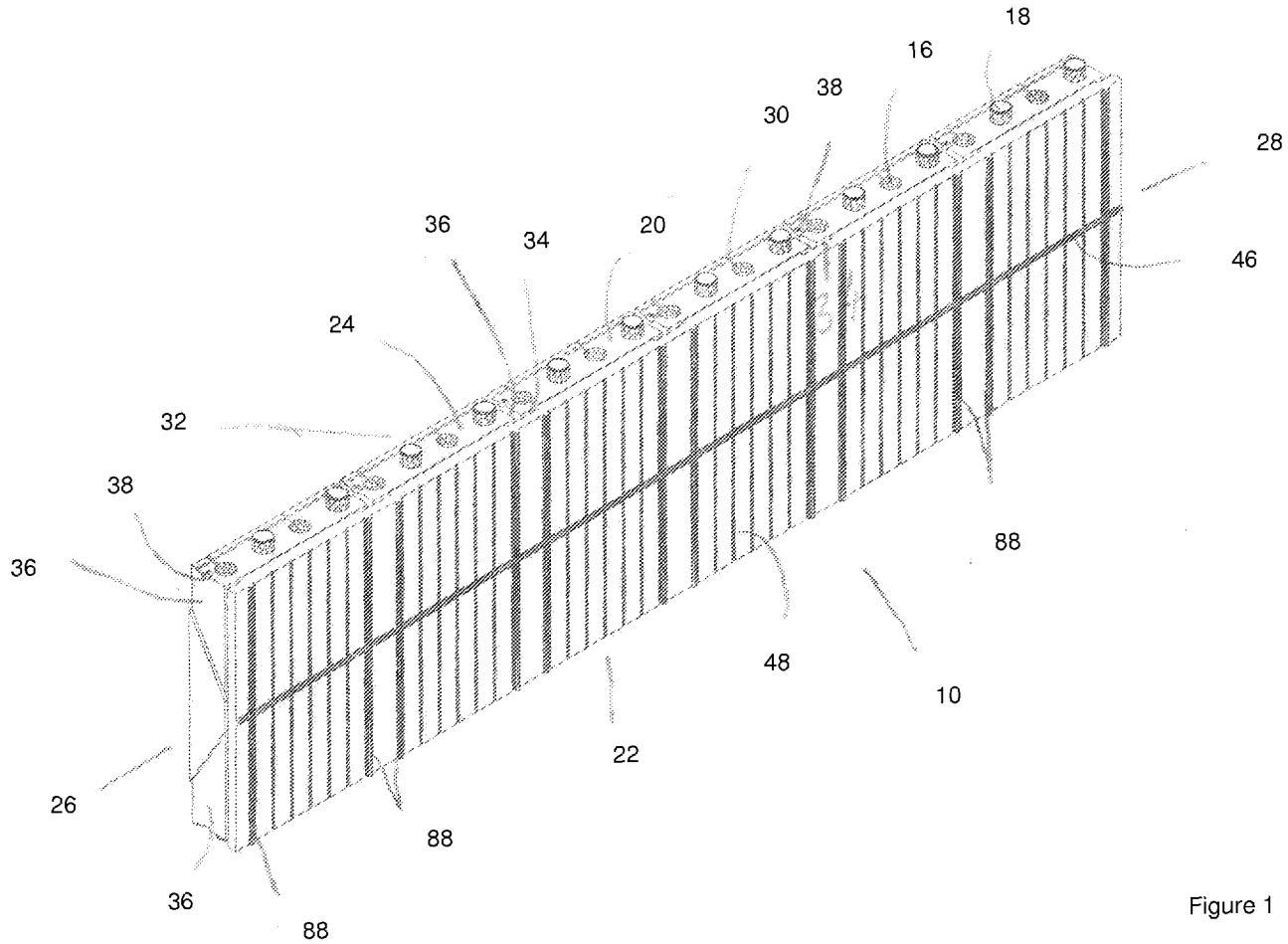
FIG. 1 is a perspective view of the front side of an insulating construction panel according to an embodiment of the present disclosure.
Figure 2:
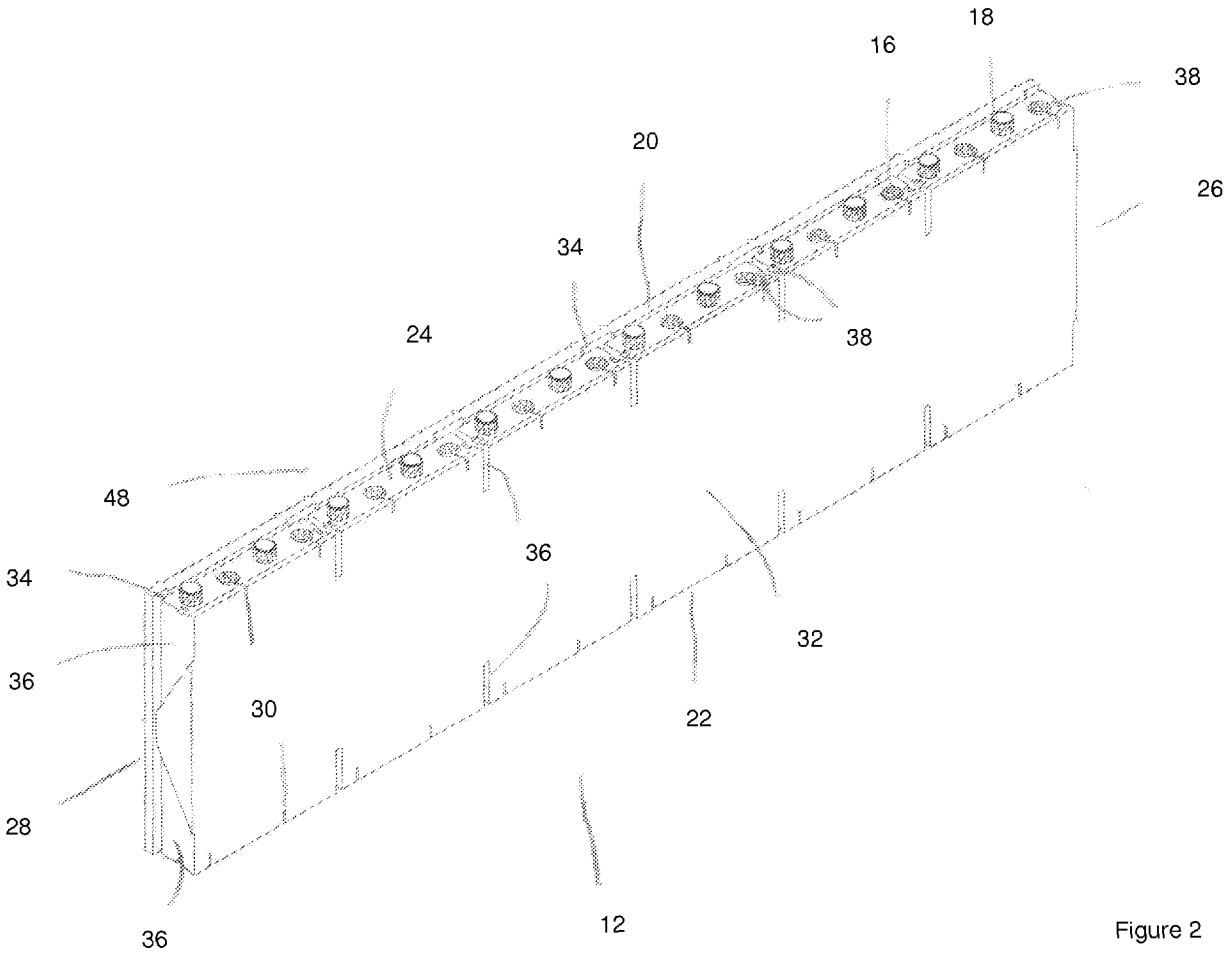
FIG. 2 is a perspective view of a rear side of the insulating construction panel according to an embodiment of the present disclosure.

FIGS. 1 and 2 illustrate perspective views of a front side 48 and a rear side 32, respectively, of an insulating construction panel 10 according to an embodiment of the present disclosure. Insulating construction panel 10 includes an end 26 and an end 28, top end 20 and bottom end 22, a front side 48 and a rear side 32. Front side 48 has a generally horizontal groove or marking 46 indicating a best location for horizontal grooving and utility installation as will be described later below. Regularly spaced double vertical grooves or markings 88 are provided and indicate locations of elongated plates that extend into passages 34 in the panel 10. This allows screws or other attachments to be inserted through the front side of panel 48 and into the elongated plates for finishes attachment. Top end 20 and bottom end 22 include an L shaped recess 24 extending from end 26 to end 28. A plurality of similarly dimensioned, alternating projections 18 and recesses 16 are also equally spaced between end 26 and end 28. Drainage grooves 30 extend from recesses 16 to the rear side 32. Regularly spaced coplanar passages 34 extend through the insulating construction panel 10 from the top end 20 to the bottom end 22. For each of coplanar passage 34 there are two perpendicularly intersecting angular passages 36 extending from the top end 20 and bottom end 22 through rear side 32. Small recesses 38 are located within the L shaped recess 24 on both sides of angular passages 36. As shown in FIG. 2, drainage grooves 30 extend from recesses 16 through the rear side 32 and the regularly spaced coplanar passages 34 extend through the insulating construction panel 10 from the top end 20 to the bottom end 22. Small recesses 38 are located within the L shaped recess 24 on both sides of angular passages 36.

Figure 3:
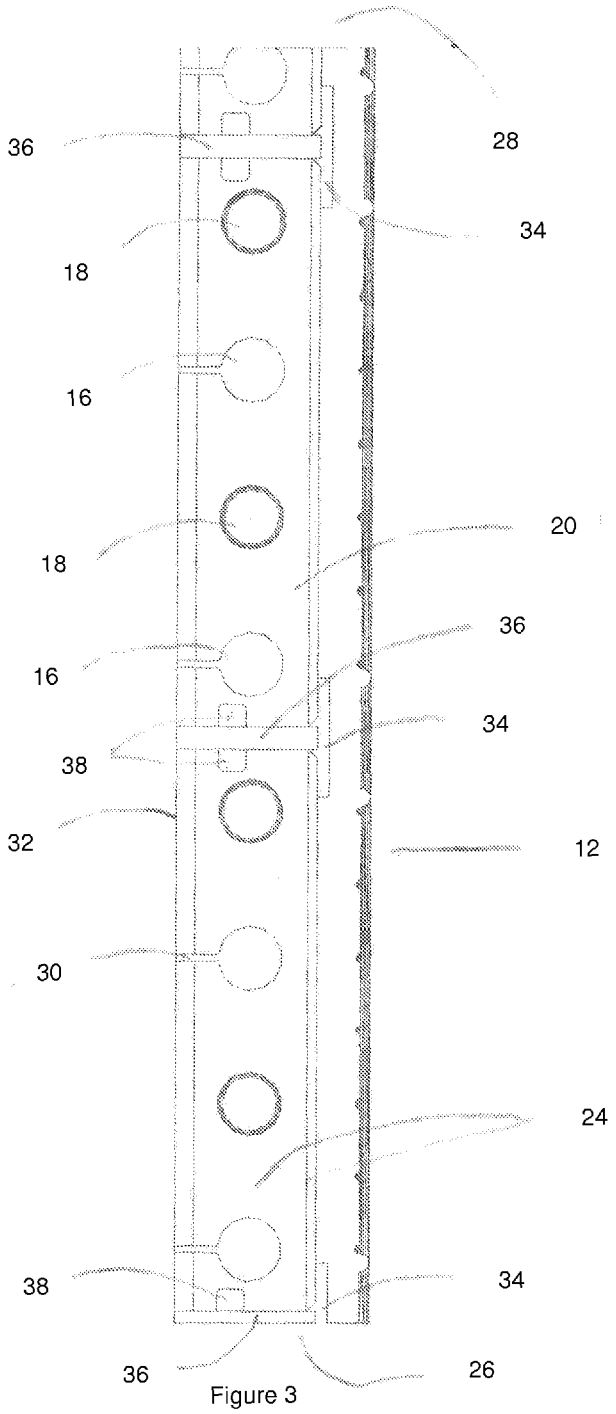
FIG. 3 is a partial top end or bottom end plan view of a construction panel according to an embodiment of the present disclosure.
Figure 4:
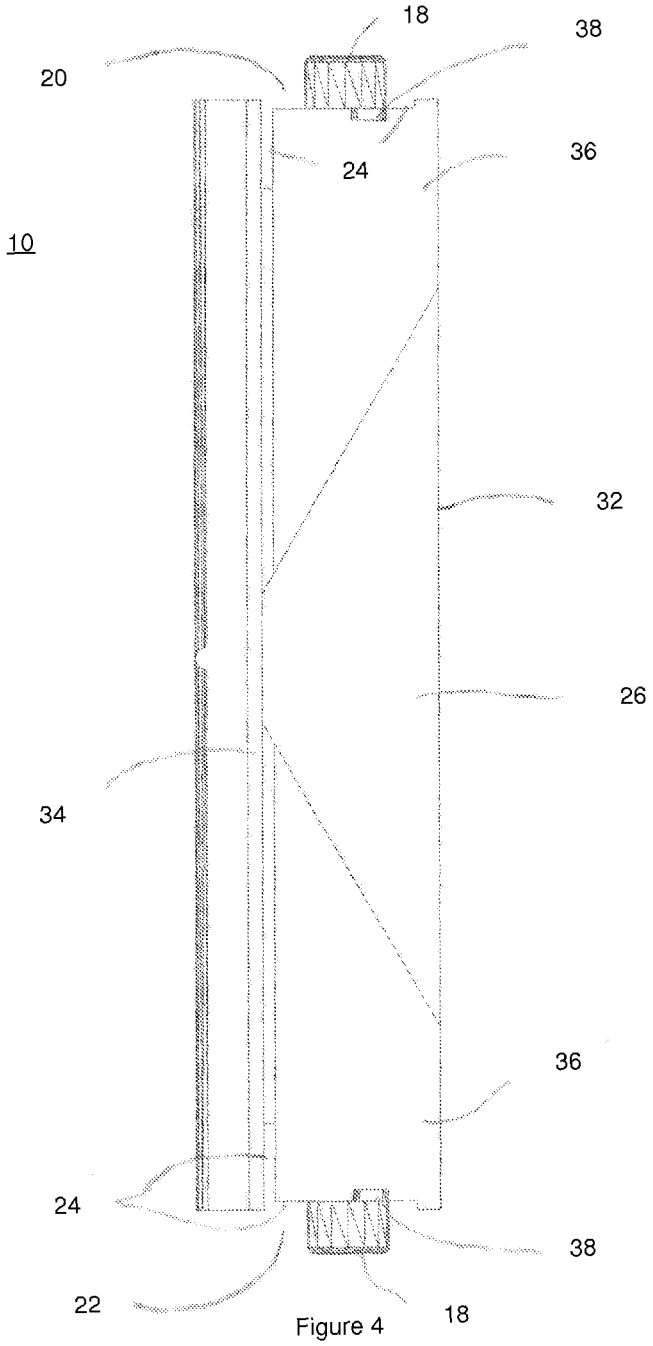
FIG. 4 an end view of a construction panel according to an embodiment of the present disclosure.

As shown in more detail in FIGS. 3 and 4, top end 20 and bottom end 22 include L shaped recesses 24. The L-shaped recesses 24 extend from end 26 of panel 10 to the other end 28 of panel 10. The top end 20 includes a plurality of similarly dimensioned, alternating projections 18 and recesses 16 equally spaced between first end 26 and second end 28. As shown in FIG. 3, drainage grooves 30 extending from recesses 16 through the rear side 32 of the panel 10. Regularly spaced coplanar passages 34 extend through the panel 10 from the top end 20 to the bottom end 22. For each coplanar passage 34 there are two perpendicularly intersecting angular passages 36 extending from the top end 20 and bottom end 22 and through to rear side 32. Small recesses 38 are located within the L shaped recess 24 on both sides of angular passages 36.

Figure 5:
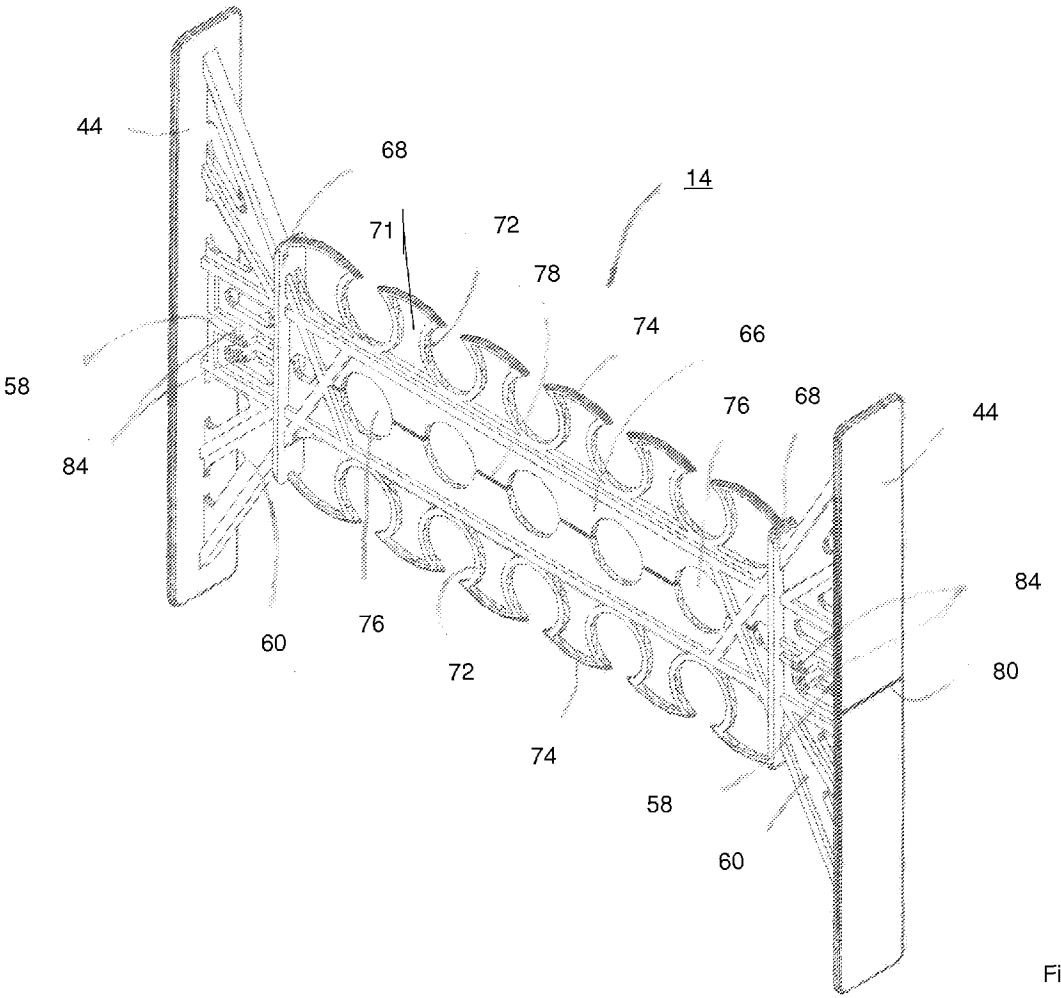
FIG. 5 is a perspective view of a single cavity tie according to an embodiment of the present disclosure.
Figure 6:
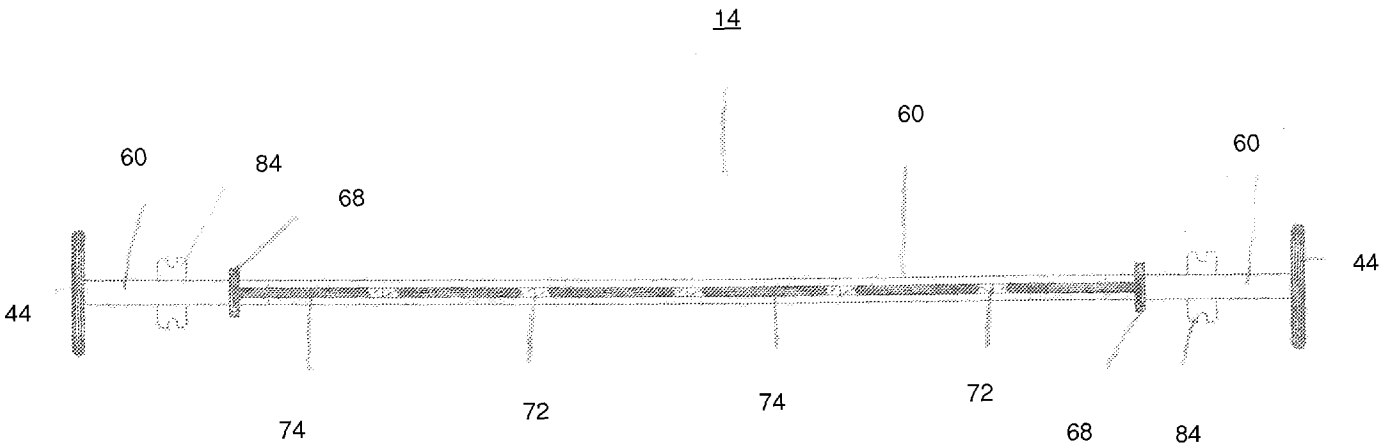
FIG. 6 is a plan view of a single cavity tie according to an embodiment of the present disclosure.
Figure 7:
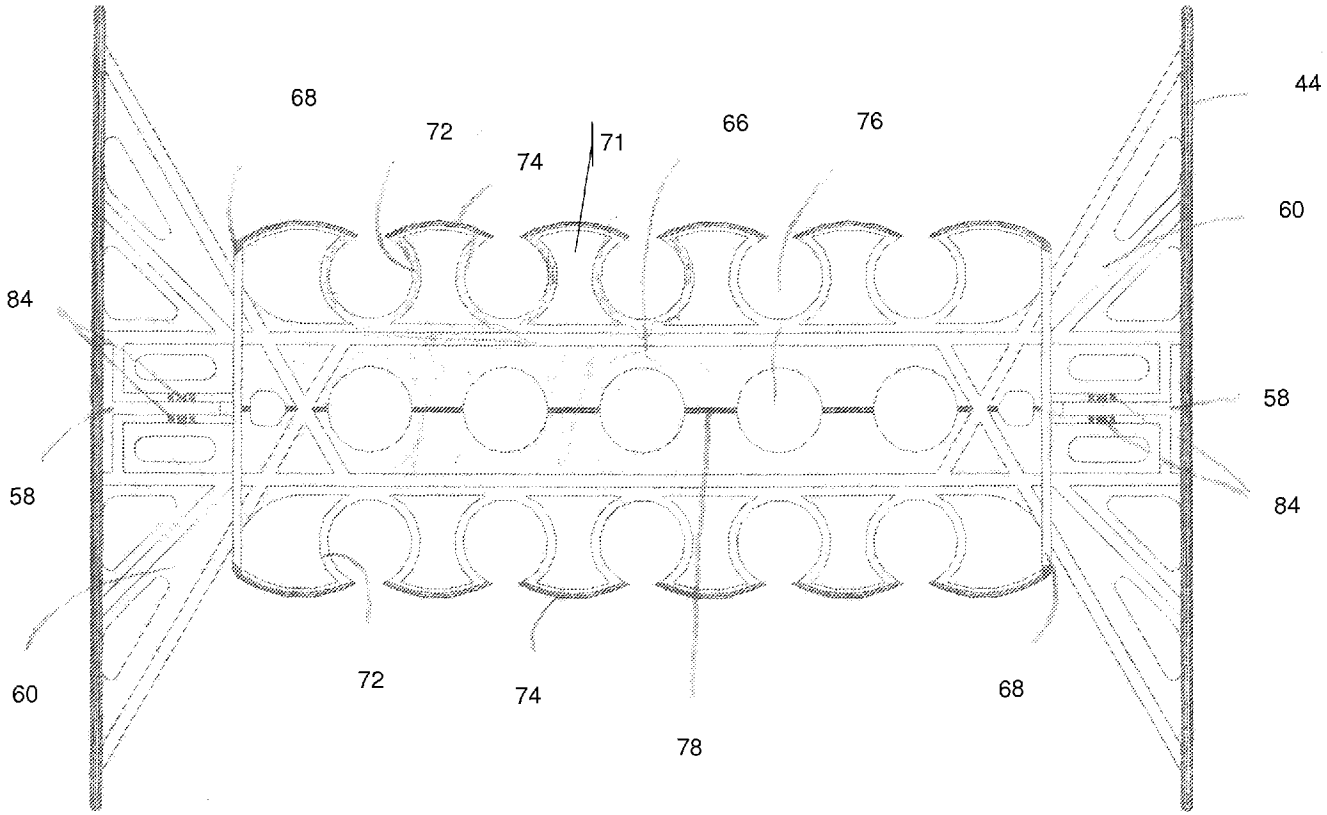
FIG. 7 is a side view of a single cavity tie according to an embodiment of the present disclosure.

FIGS. 5-7 illustrate views of a single cavity tie 14, according to embodiments of the present disclosure. Tie 14 includes spacer 66, perpendicular stoppers 68, angular connector 60, and perpendicular elongated plates 44 with horizontal marking 80 along the center. Regularly spaced open rings 72 are located on top and bottom of spacer 66. Open portions 71 provide a certain amount of flexibility to the open rings 72. Open rings 72 are provided allowing rebar or other structural members to be added to the foundation as desired. Arched ring connectors 74, regularly spaced orifices 76, continuous horizontal marking 78 along the center of spacer 66 are also provided. Angular connectors 60 include centrally located T-shaped passages 58 and tabs 84 extending perpendicularly from angular connector 60 on both sides above and below T-shaped passages 58.

Figures 8, 9, 10:
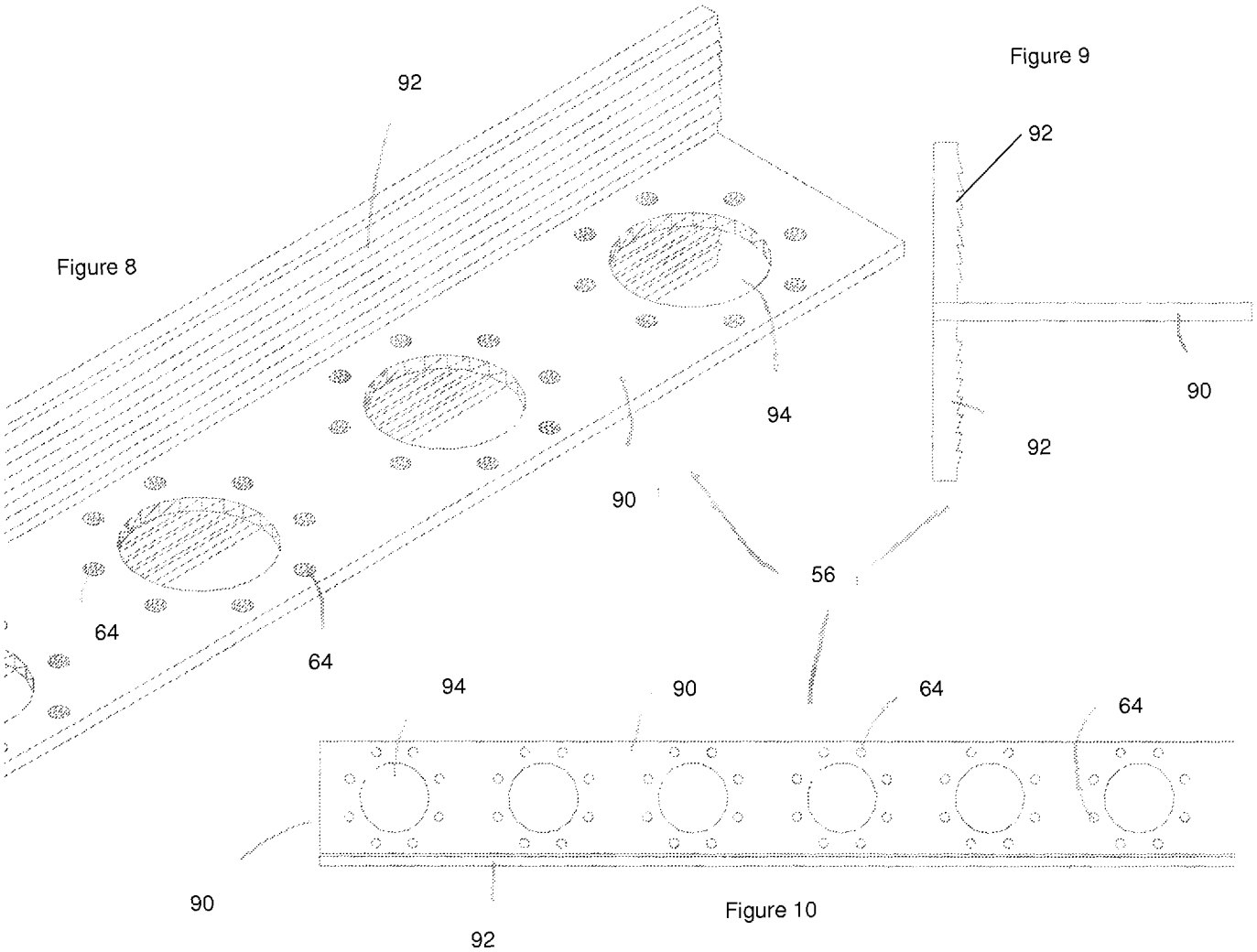
FIG. 8 is a fragmental perspective view of T-shaped molding according to an embodiment of the present disclosure.
FIG. 9 is an end view of a T-shaped molding according to an embodiment of the present disclosure.
FIG. 10 is a fragmental plan view of a T-shaped molding according to an embodiment of the present disclosure.

FIGS. 8-10 illustrate views of T-shaped molding 56. T-shaped molding 56 includes web 90 perpendicularly attached to the center of a ribbed flange 92. Web 90 includes regularly spaced orifices 94 and smaller orifices 64 uniformly arrayed around orifices 94. Regularly spaced orifices 94 are dimensioned to receive regularly spaced projections 18 on panels 10. Orifices 64 allow screws, nails, etc. to be used to hold T-shaped molding 56 in place between panels 10. T-shaped molding 56 and ties 14 can be made of any suitable type of material such as, for example, plastics, metals, alloys, etc.

Figure 11:
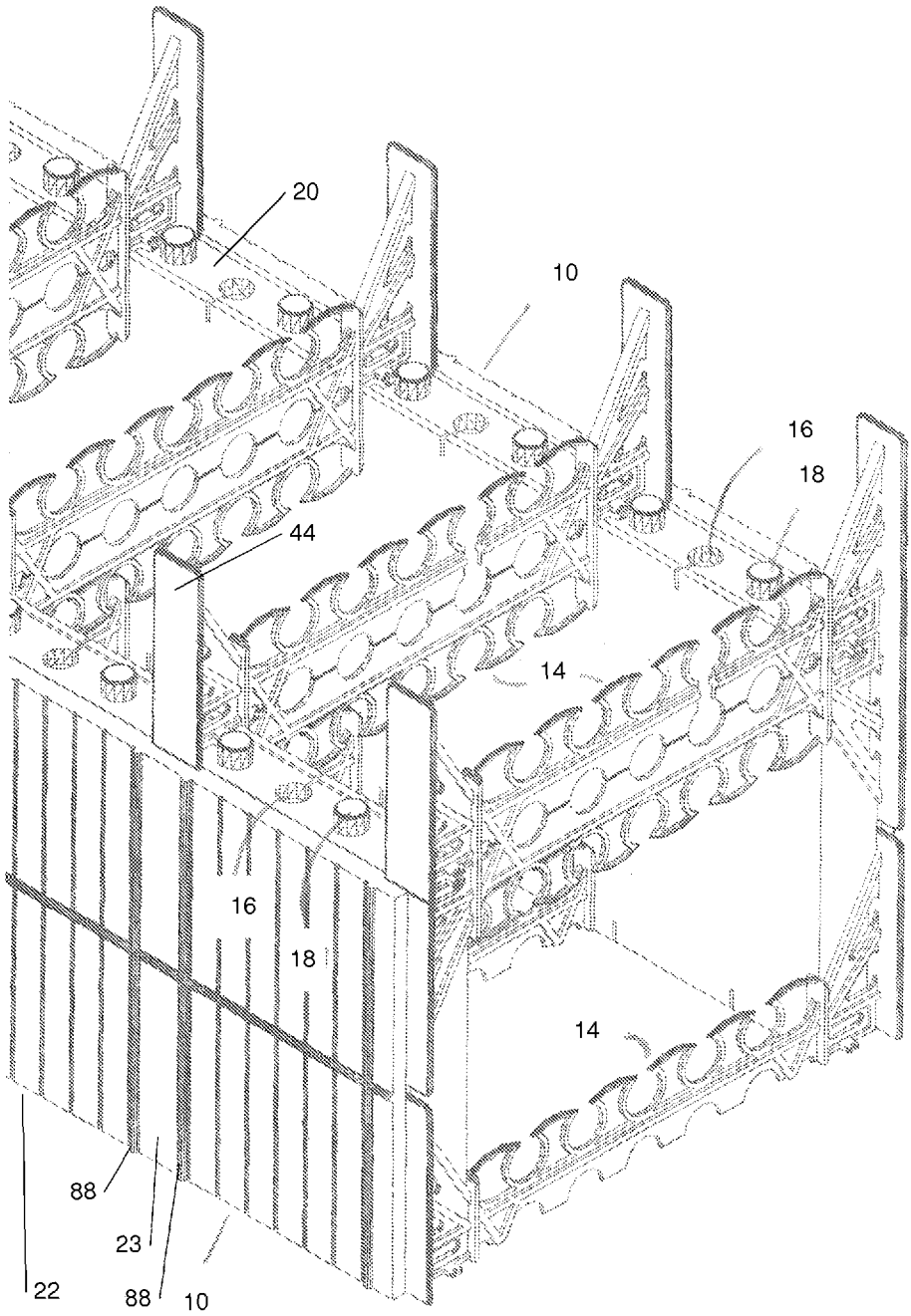
FIG. 11 is a fragmental perspective view of an insulating concrete form constructed in accordance with an embodiment of the present disclosure.

FIG. 11 illustrates portions of two identical insulating construction panels 10 interlocked with a plurality of insertable ties 14 at the top end 20 of panels 10 and a plurality of half-ties of the insertable ties 14 at the bottom end 22 of panels 10. The ties 14 hold panels 10 in a fixed spaced parallel relationship, thereby defining the cavity dimension of the concrete form. Panels 10 are adapted to be stacked and interlocked with other insulating concrete panels by the plurality of ties 14, recesses 16 and projections 18 in a bi-directional and/or reversible manner. Vertical grooves or markings 88 provide references for indicating location of the elongated plates 44. Plates 44 make secure attachment points for nails, screws, etc. used for mounting finishing materials to the face of panels 10.

Figure 12:
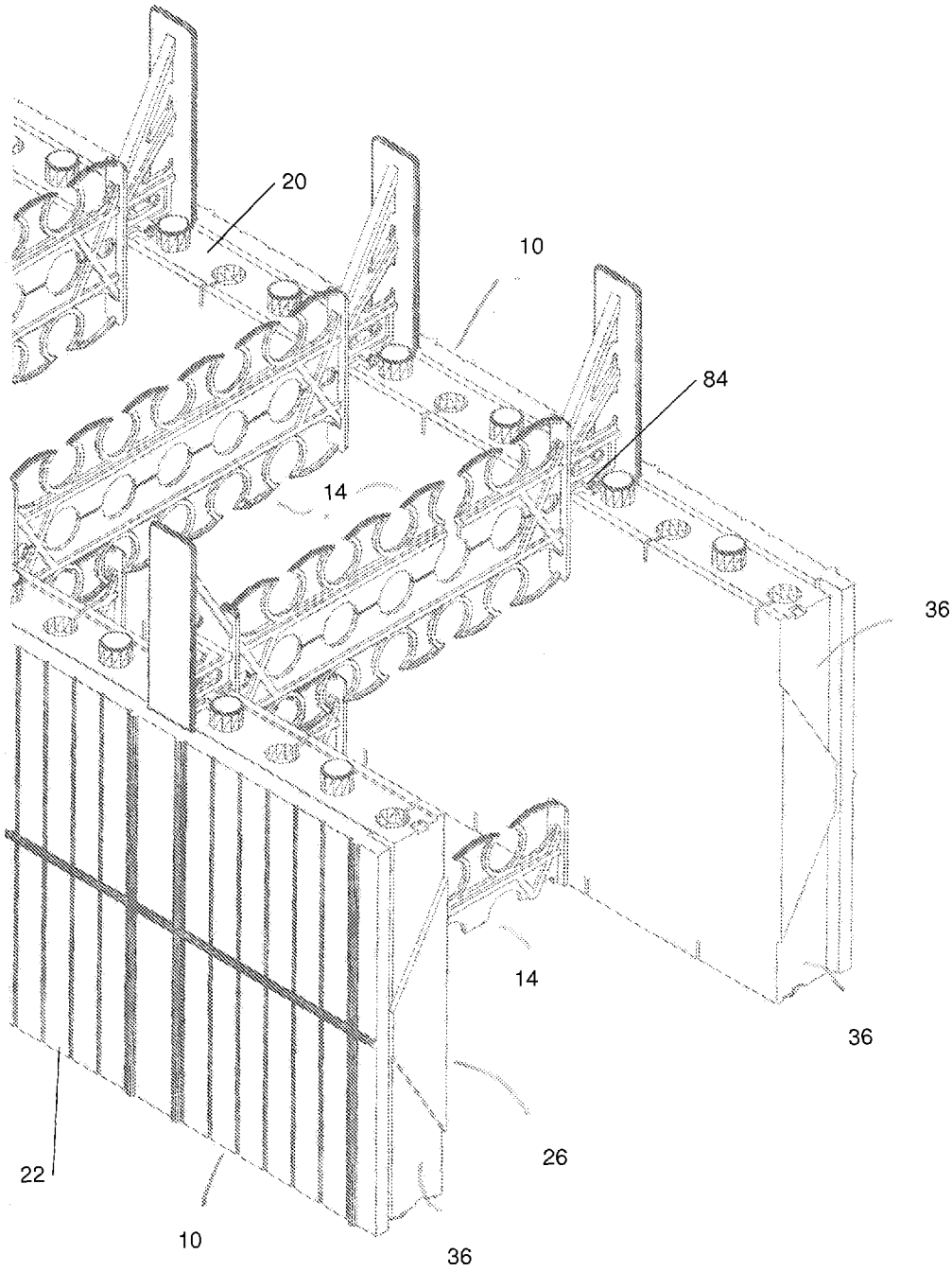
FIG. 12 is a fragmental perspective view of an insulating concrete form according to an embodiment of the present disclosure showing the ends of panels without an insertable tie.
Figure 13:
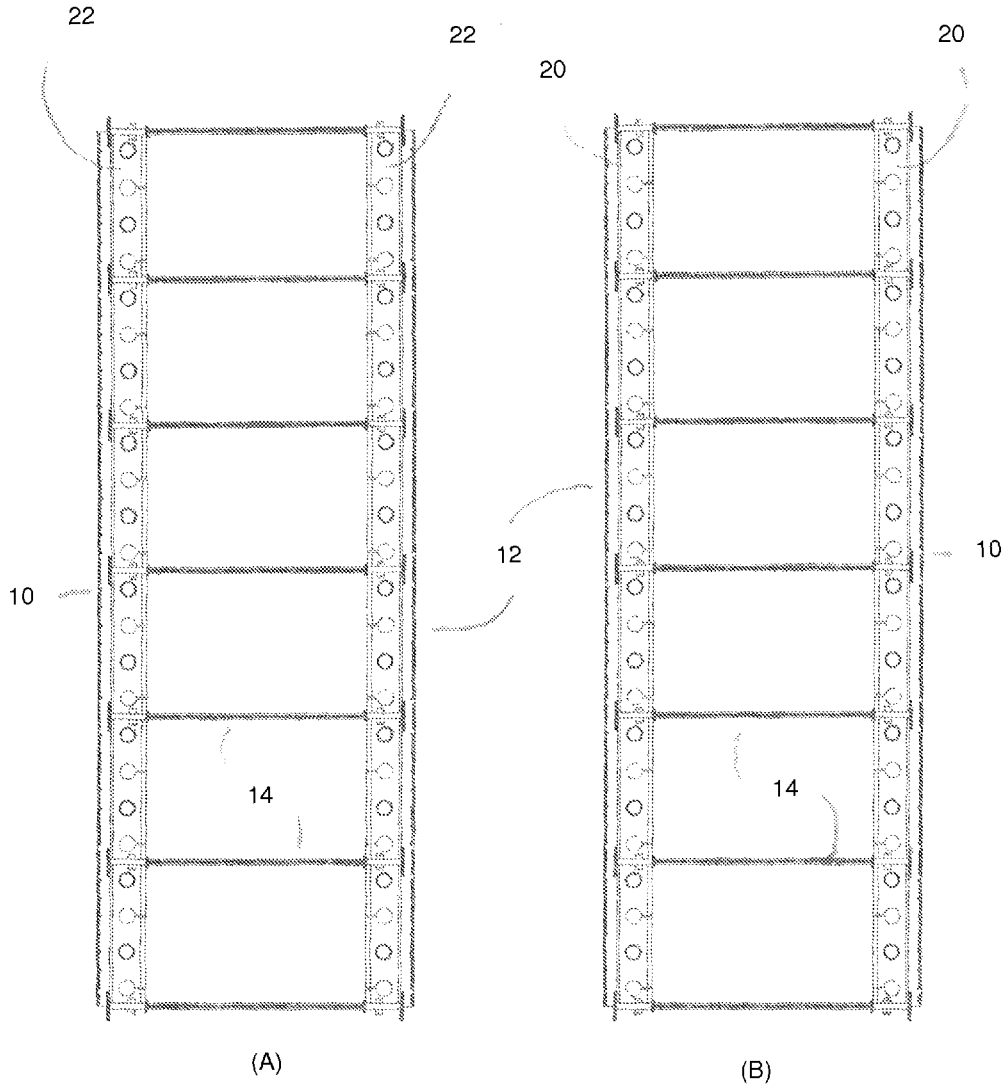
FIGS. 13A and 13B are top end and bottom end plan views, respectively, of the insulating concrete form of FIG. 11 according to an embodiment of the present disclosure.

FIG. 12 illustrates portions of two identical insulating construction panels 10 interlocked with a plurality of insertable ties 14 at the top end 20 of panels 10 and a plurality of half-ties of the insertable ties 14 at the bottom end 22 of panels 10. The ties 14 have been removed from an end 26 of construction panels 10 for ease of viewing. Screws, nails, etc. can be driven through tabs 84 and into panel 10 to hold ties 14 in place against panels 10 if necessary FIGS. 13A and 13B illustrate two identical insulating construction panels 10 interlocked with a plurality of insertable ties 14 at the top end 22 (FIG. 13A) and bottom end 20 (FIG. 13B) of panels 10.

Figure 14:
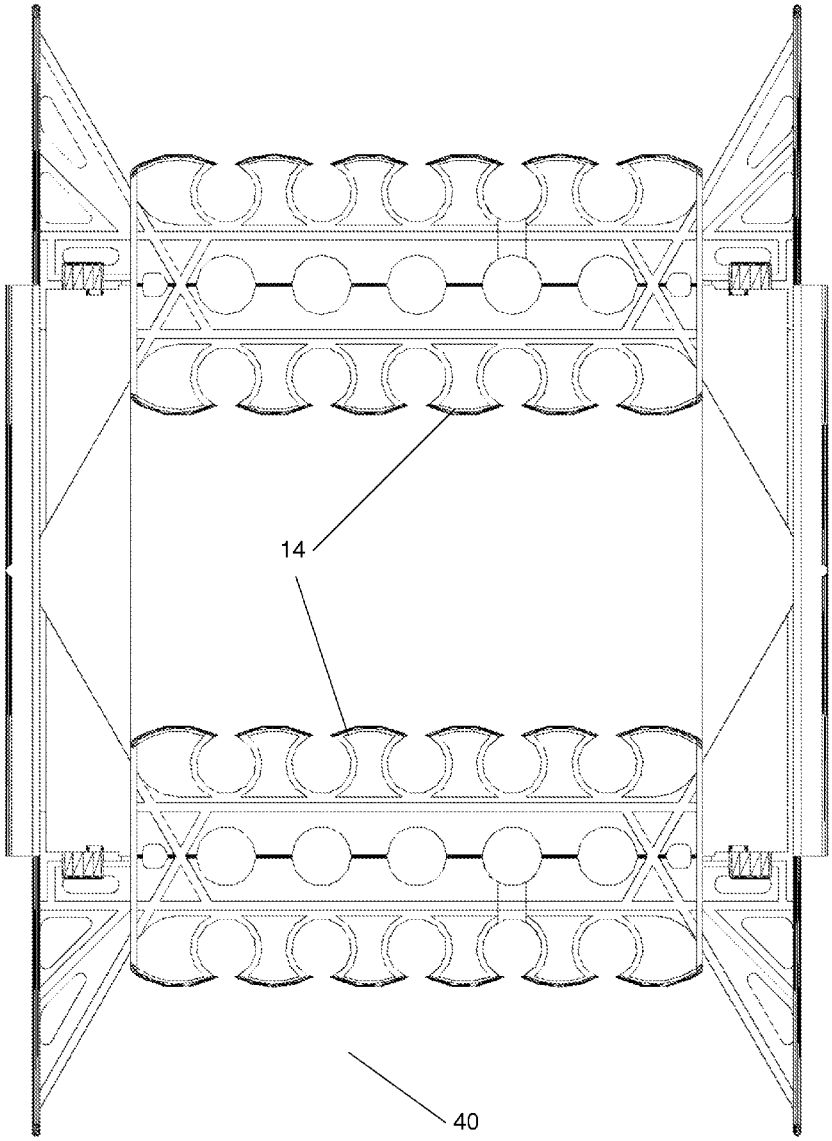
FIG. 14 is an end view of an assembled insulating concrete form according to an embodiment of the present disclosure with tie removed from the end of form.
Figure 15:
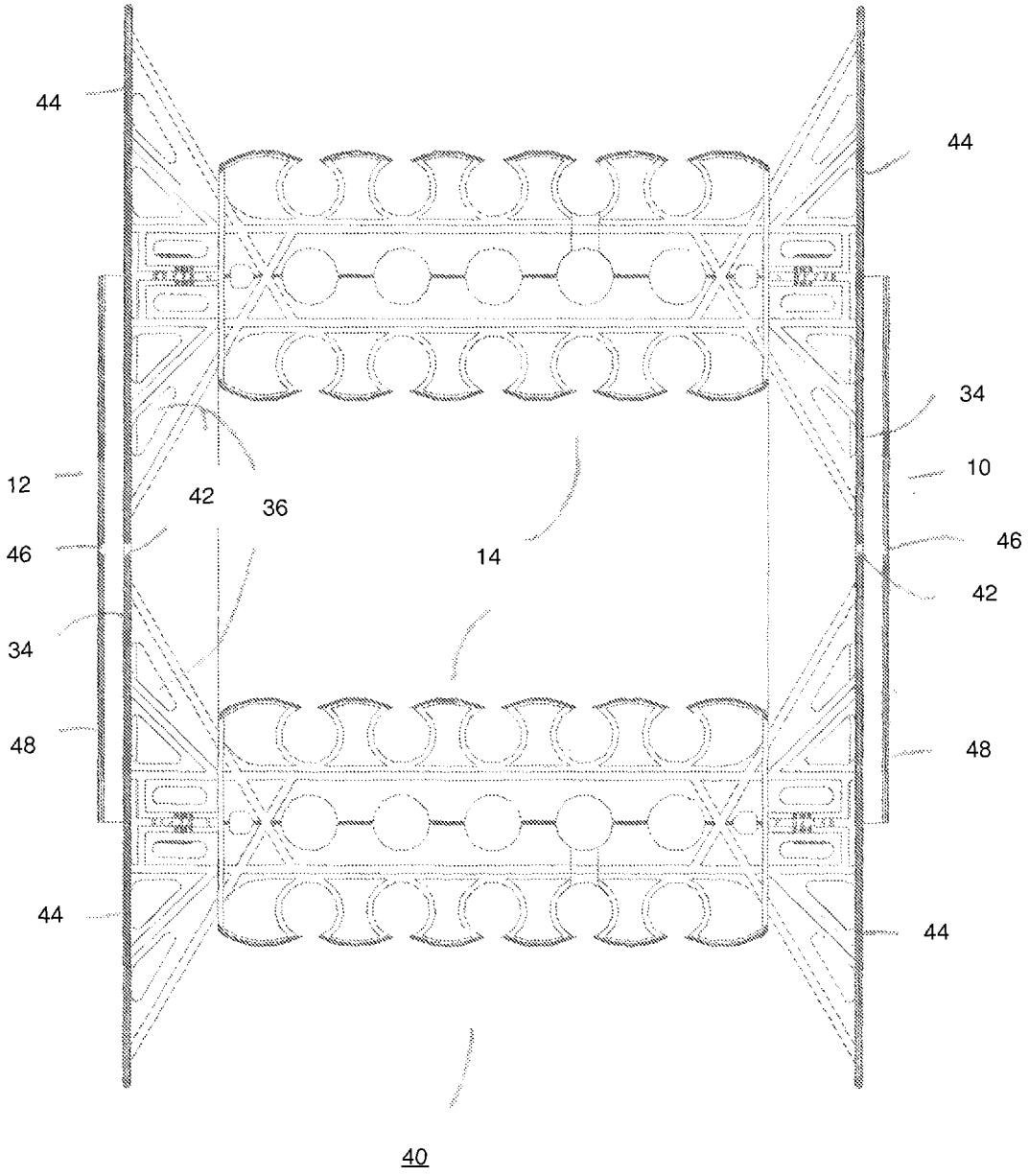
FIG. 15 is an end view of an assembled insulating concrete form according to an embodiment of the present disclosure showing full ties.

FIGS. 14 and 15 illustrate end views of the assembled concrete form 40. The form 40 includes opposing construction panels 10 interlocked with a plurality of insertable ties 14. Ties 14 are inserted in to coplanar passages 34 and angular passages 36 at the top end 20 and bottom end 22 of construction panels 10. There are small gaps 42 between elongated plates 44 for easy cutting and utility installation in construction panels 10. Continuous horizontal marking 46 at front side 48 of construction panel 10 indicate a best location for horizontal grooving and installation of utilities.

Figure 16:
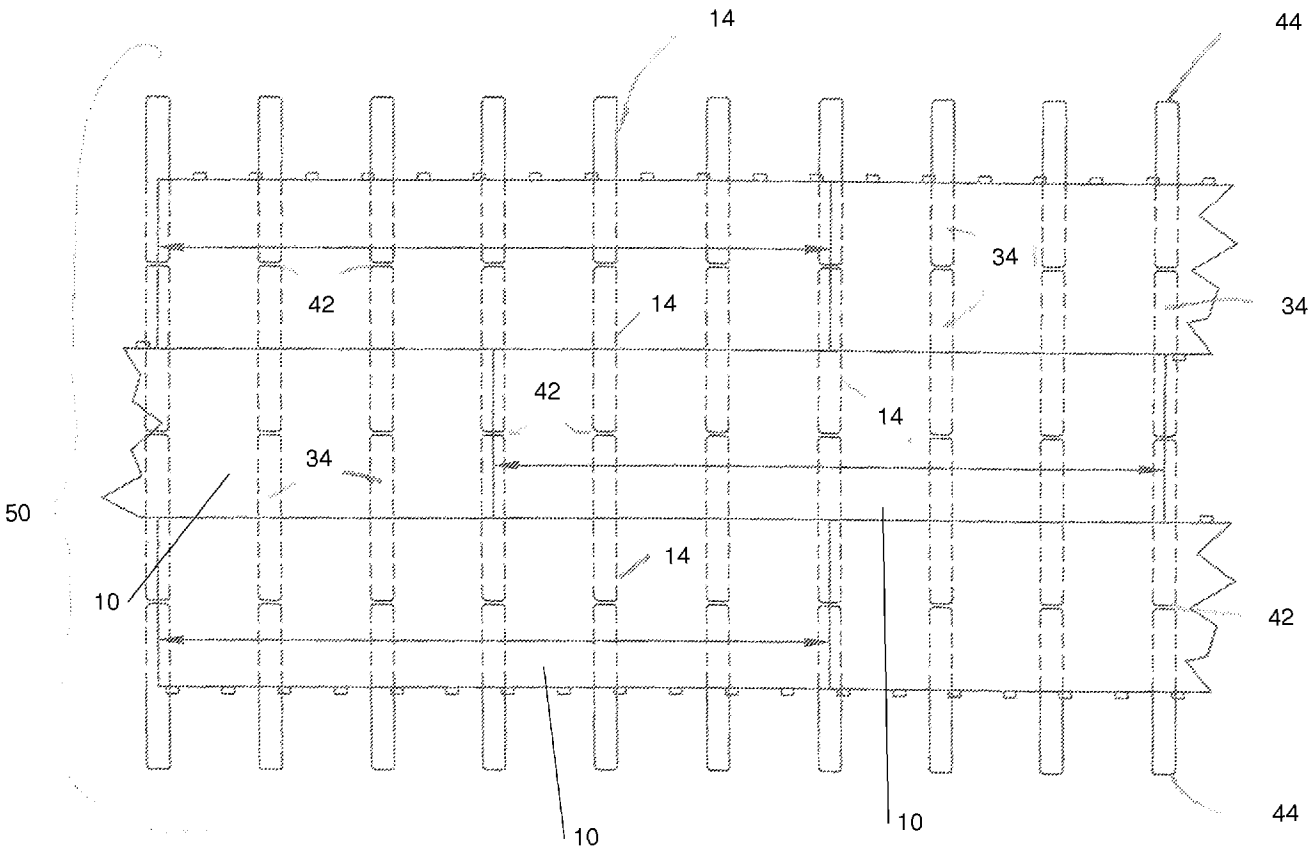
FIG. 16 is an elevation view of an assembled insulating concrete form according to an embodiment of the present disclosure, showing locations of insertable ties located within the front end of the construction panels.

FIG. 16 illustrates a side view of an assembled wall elevation 50 formed of a plurality of overlapping rows of vertically and horizontally aligned construction panels 10 connected with a plurality of ties 14 inserted into coplanar passages 34 and angular passages 36 at the top end 20 and bottom end 22 of construction panels 10. The interlocking of rows of construction panels results in perfect alignment of ties 14 and elongated plates 44 throughout the entire wall. Perfect alignment of elongated plates 44 greatly improves installation of wall finishes. Small gaps 42 between elongated plates 44 located in the center of each construction panel 10 greatly improve ease of cutting grooves and installation of utilities. Central location of gap 42 within each construction panel 10 prevents fresh concrete from entering into the preferred location for grooving and installing utilities within the construction panels 10.

FIG. 17 illustrates a perspective view of single cavity corner concrete form assembled with four identical construction panels 10 (10*a*, 10*b*, 10*c* and 10*d*) interlocked with a plurality of ties 14 and four T-shaped moldings 56. T-shaped molding 56 is shaped and dimensioned to be inserted through the T-shaped passage 58 located in the center part of angular connectors 60 and placed over the protrusions 18 of construction panels 10 into the L-shaped recesses 24. A small portion of T-shaped molding ribbed flange 92 is removed to overlap each other and interlock together at four points 62. The ties 14 that crisscross in the corner as shown in FIG. 17 are standard ties described above. According to embodiment of the present disclosure, the ties 14 are altered by cutting, in field, through spacer 66 from ring 72 thru to orifices 76. The cut is made at the top of one tie, and on the bottom of the tie that it crisscrosses in order to interconnect the ties.

Figure 18:
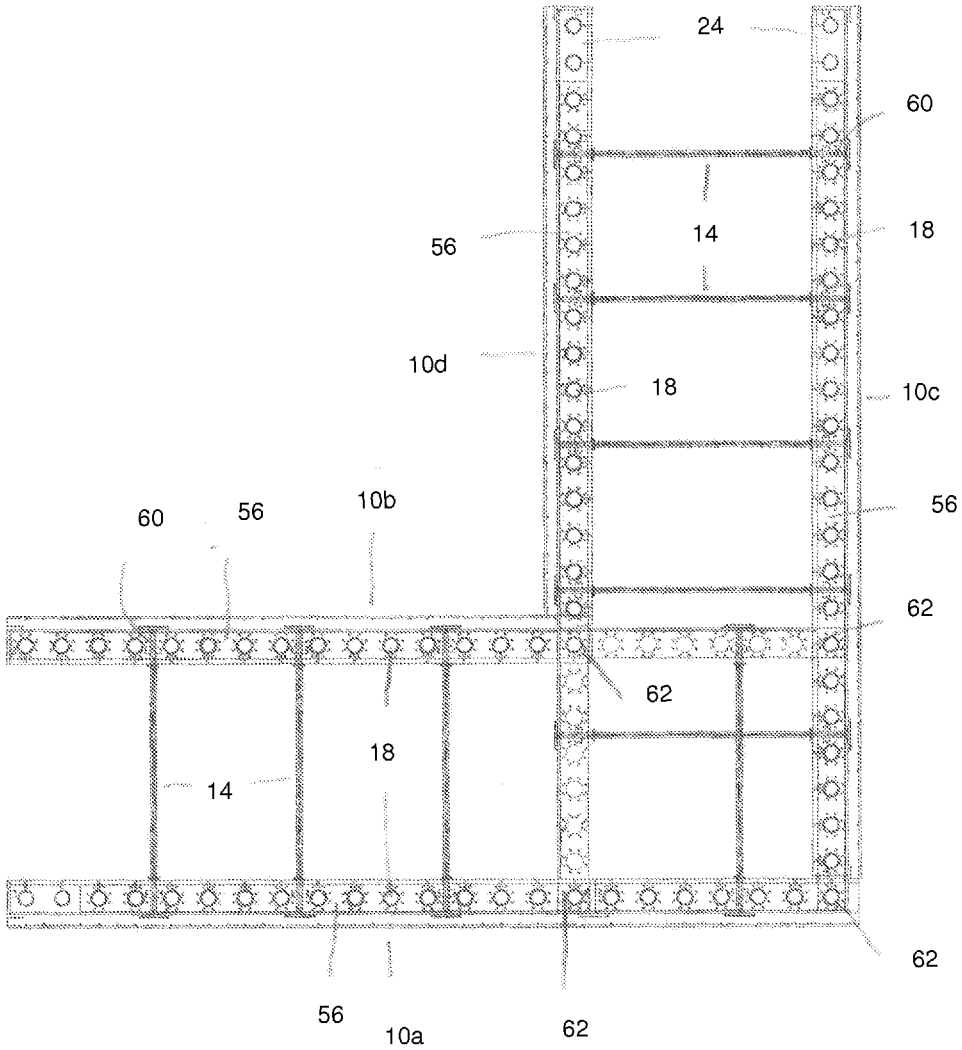
FIG. 18 is a plan view of an assembled corner form according to an embodiment of the present disclosure showing construction panels, ties and T-shaped moldings.

FIG. 18 illustrates a plan view of a corner of the concrete form assembled with four identical construction panels 10 interlocked with the plurality of ties 14 and four T-shaped moldings 56. T-shaped molding 56 is inserted through the T-shaped passage 58 located in the center part of angular connectors 60 and placed over the protrusions 18 of construction panels 10 and into the L-shaped recesses 24.

Figure 19:
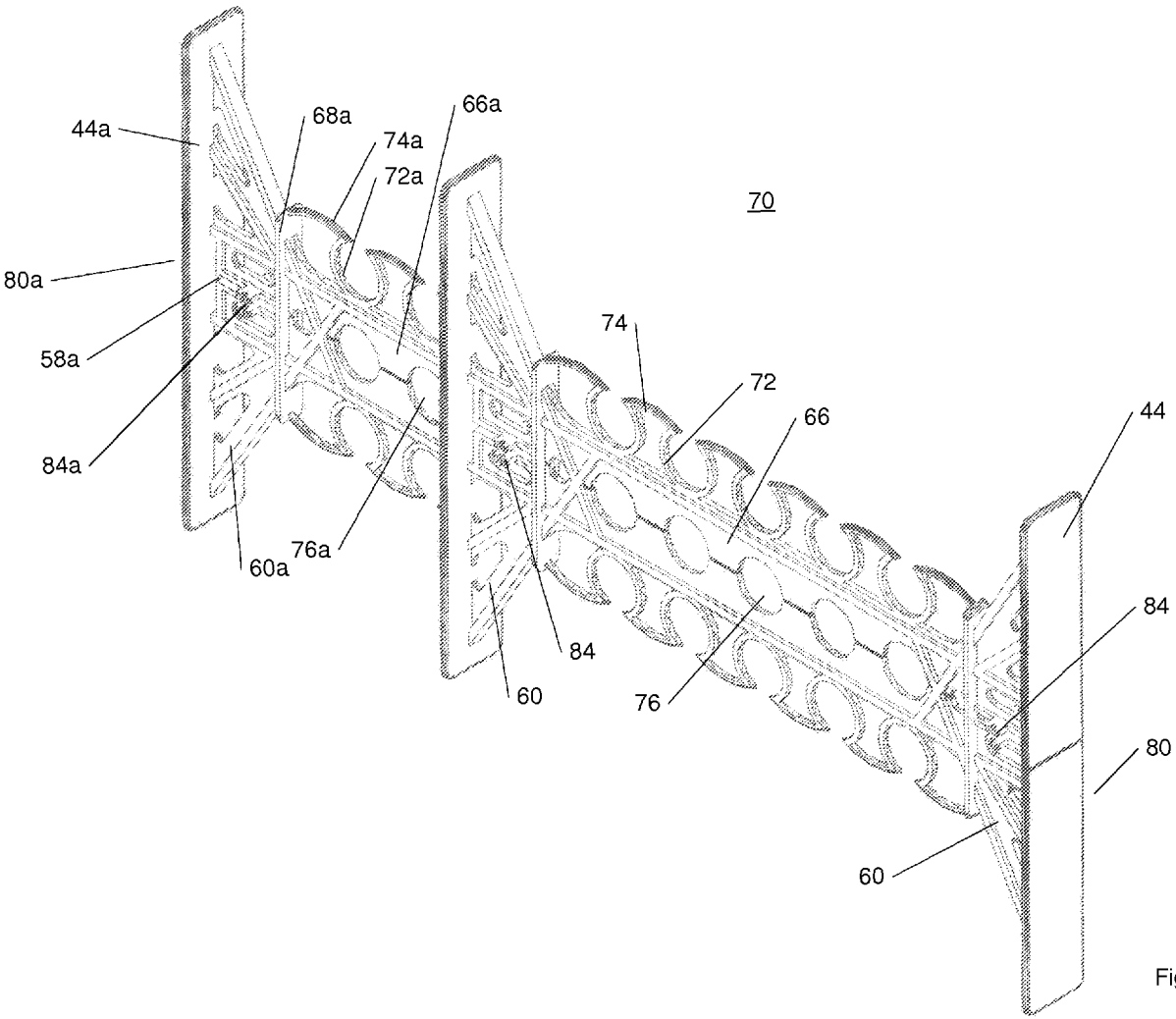
FIG. 19 is a perspective view of a multi-cavity tie according to an embodiment of the present disclosure.
Figure 20:
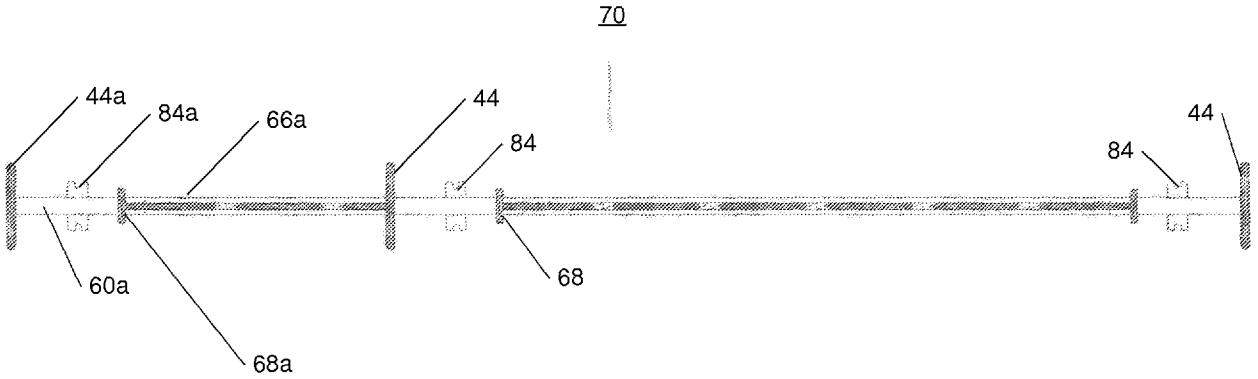
FIG. 20 is a plan view of a multi-cavity tie according to an embodiment of the present disclosure.
Figure 21:
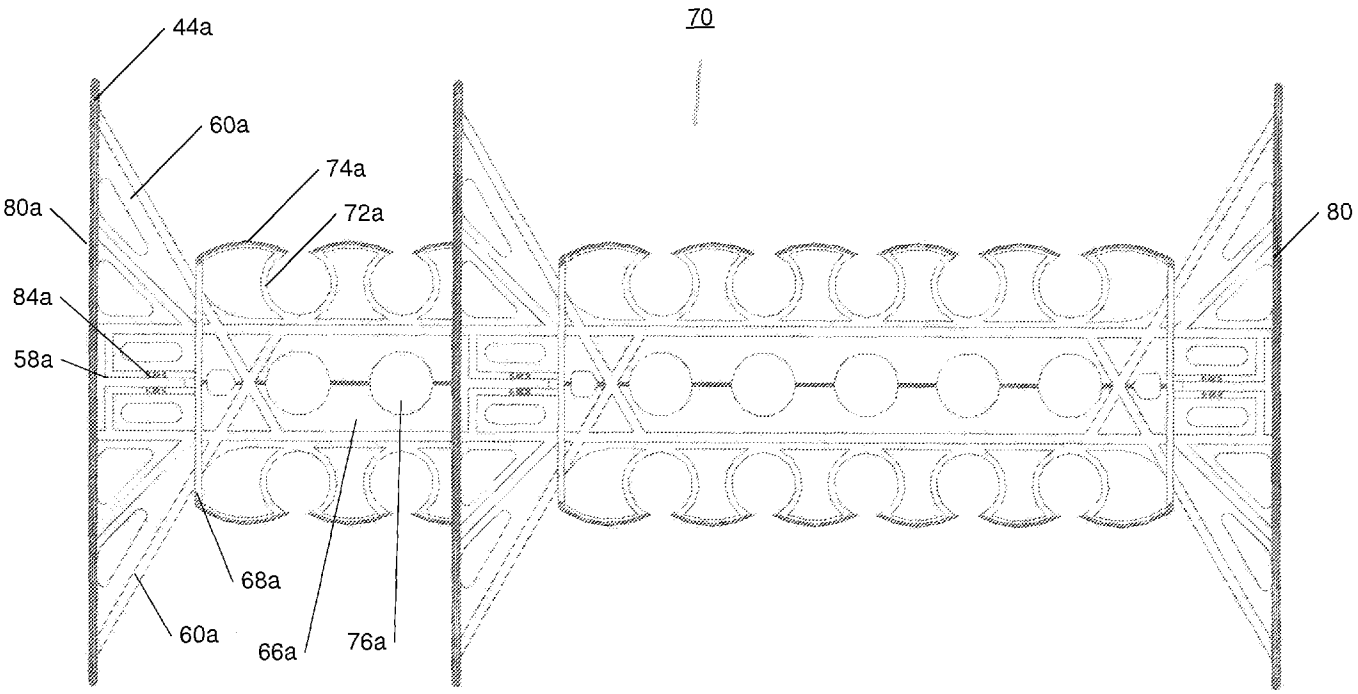
FIG. 21 is a side view of a multi-cavity tie according to an embodiment of the present disclosure.

According to another embodiment of the present disclosure, a multi-cavity form can be used to form a pair of parallel concrete sections, providing an additional layer of insulation, sound barrier, etc. According to this embodiment, a multi-cavity tie 70 as shown in FIGS. 19-21 is provided. The multi-cavity tie 70 is similar to the ties 14 described above but includes several additional features. As shown, multi-cavity tie 70 includes an additional spacer 66*a*, perpendicular stopper 68*a*, angular connector 60*a*, and perpendicular elongated plates 44*a* with horizontal marking 80*a* along the center. Regularly spaced open rings 72*a* are located on top and bottom of spacer 66*a*. Arched ring connectors 74*a*, regularly spaced orifices 76*a* are also provided. Angular connectors 60*a* include centrally located T-shaped passages 58*a* and tabs 84*a* extending perpendicularly from angular connector 60*a* on both sides above and below T-shaped passages 58*a*.

Figure 22:
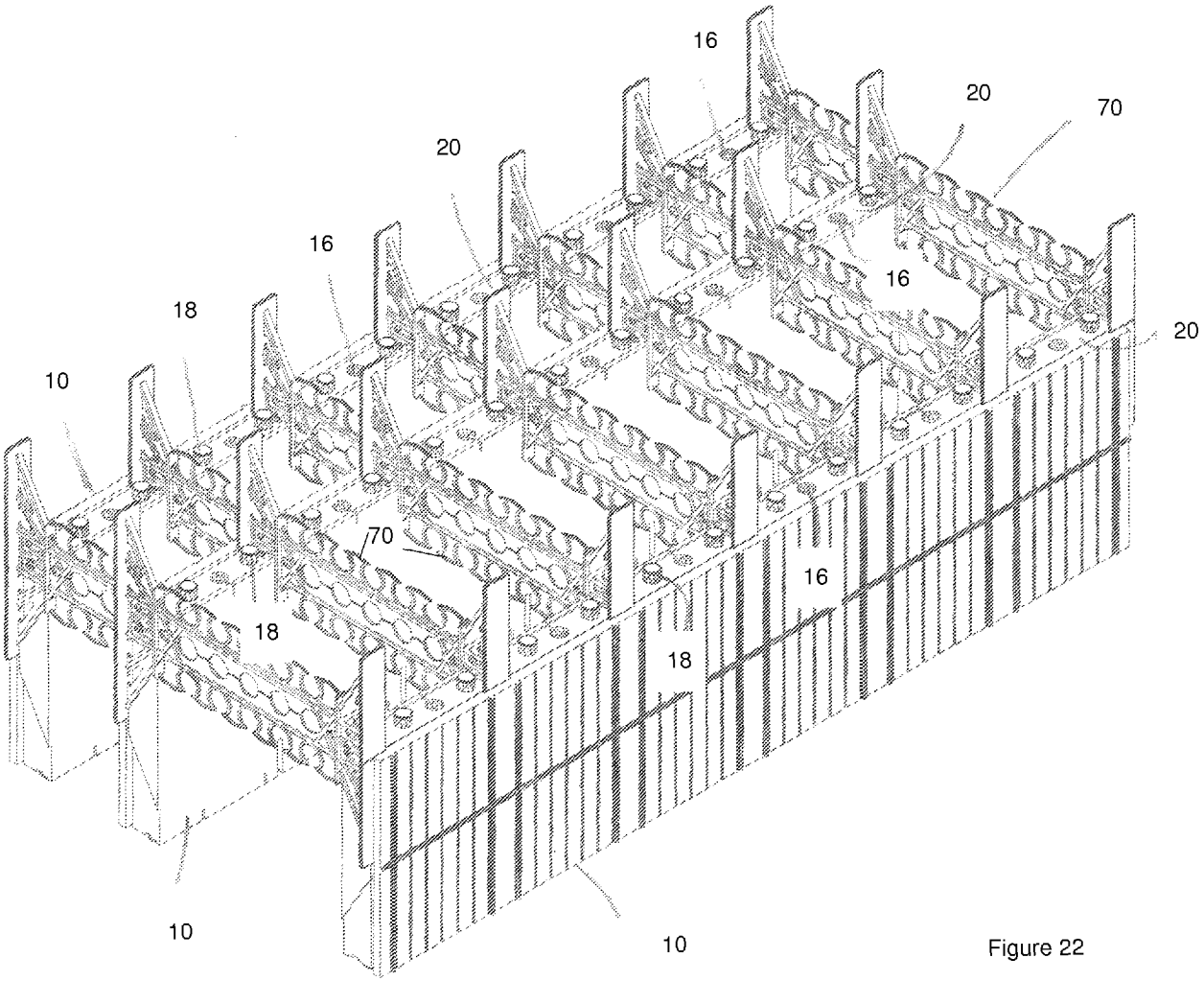
FIG. 22 is a perspective view of a multi-cavity insulating concrete form according to an embodiment of the present disclosure.
Figure 23:
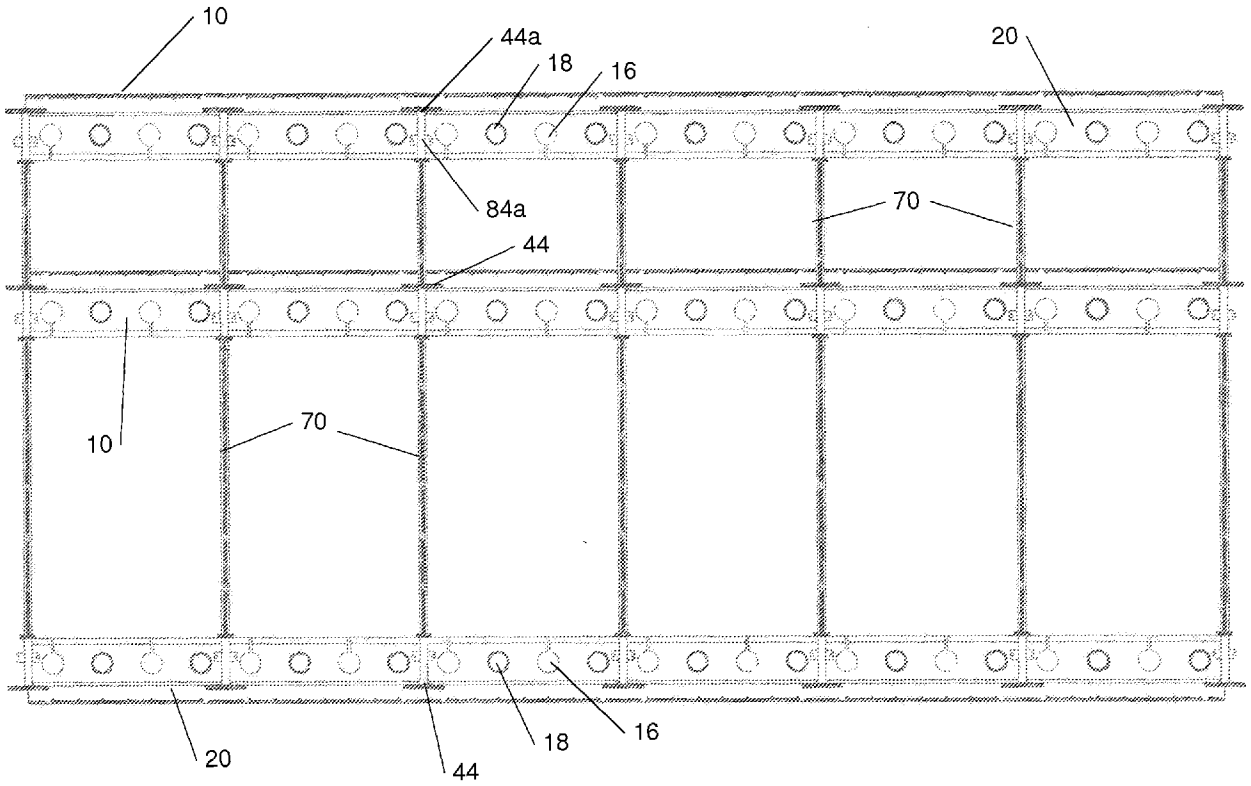
FIG. 23 is a plan view of a multi-cavity insulating concrete form according to an embodiment of the present disclosure.
Figure 24:
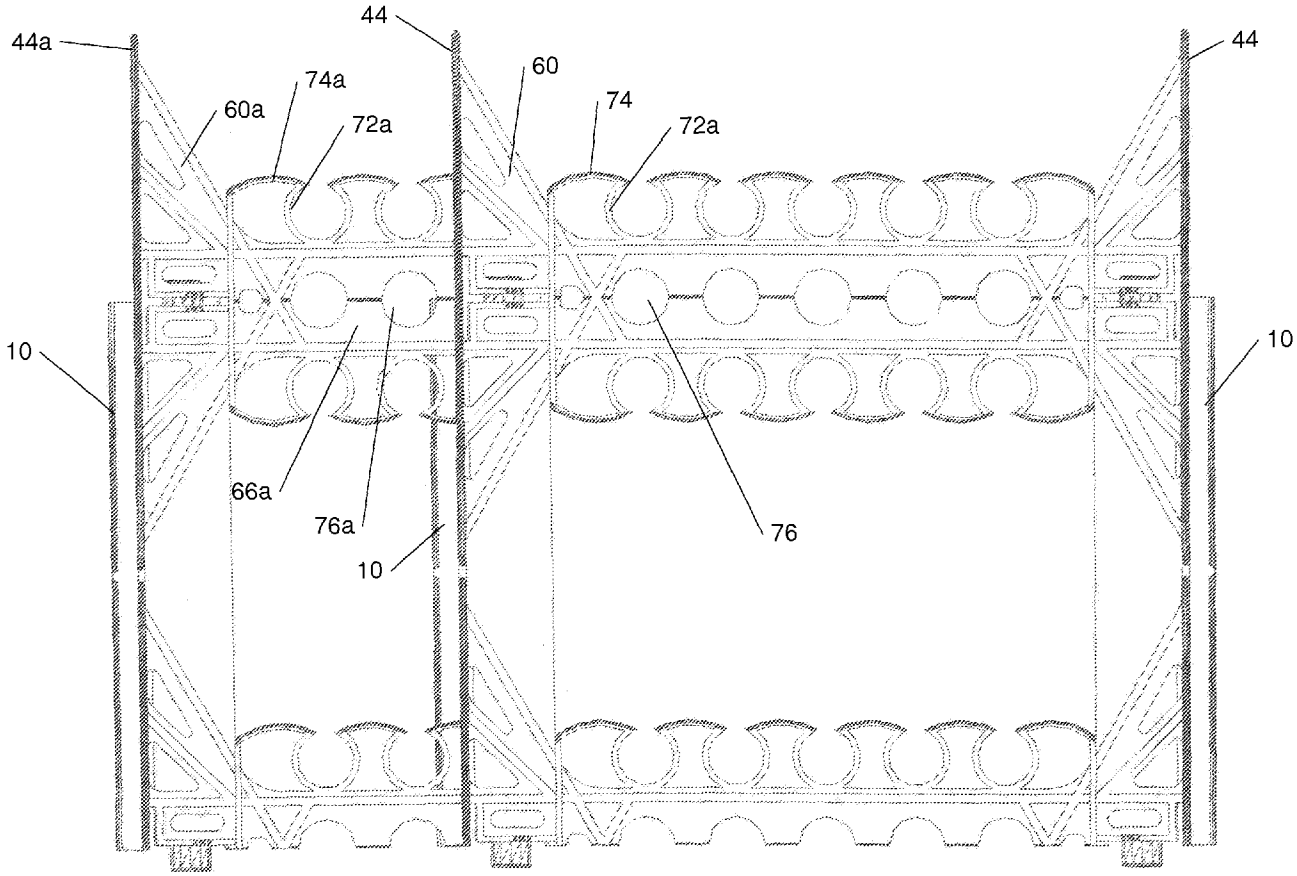
FIG. 24 is an end view of a multi-cavity insulating concrete form according to an embodiment of the present disclosure with half-ties at bottom end of construction panel.

FIGS. 22-24 illustrate various views of three identical insulating construction panels 10 interlocked with a plurality of insertable multi-cavity ties 70 at the top end 20 of panels 10. The multi-cavity ties 70 hold panels 10 in a fixed spaced parallel relationship, thereby defining the multi-cavity dimensions of the concrete form. Panels 10 are adapted to be interlocked with other insulating concrete panels by the plurality of multi-cavity ties 70, recesses 16 and projections 18 in a bi-directional and/or reversible manner.

Embodiments of the present disclosure provide several salient features. For example, according to embodiments of the present disclosure, no webs, spacers, or ties are molded into the insulating construction panels which results in lower labor costs during production. Since the ties are not permanently embedded in the insulating construction panels, tie scraps can be easily recycled. In addition, because the insulating construction panels can be manufactured from only one type of material, recycling of scraps is easier, less expensive, and improves "Green Building" practice. The present system has no need for pre-molded corner panels. This allows the components to be packed and shipped using less volume than those using pre-molded corner panels, thus providing savings on storage, shipping and handling.

In addition, all of the insulating construction panels are interlocked by vertically lined up ties which cannot shift, therefore providing a reliable location for attaching finishing materials. The horizontal utility installation spot is located in the center of the insulating construction panels, away from ties and concrete which, in prior systems, would get in between panels during the concrete pour. This makes installation of utilities easier and results in fewer damaged tools that would otherwise be damaged by contact with stray concrete.

The shape of the rings 72 in the ties greatly improves installation and removal of reinforcing bars or tools like chalk line or measuring tape.

Since the insulating construction panels can be made from a single component, many different materials can be used to make them. For example, foam panels provide excellent insulating volume. In addition, autoclaved aerated concrete panels trademarked under the name AERCON, would provide great fire protection. Panels with a finishing surface can be used on one side to provide finished elevation without installation of additional materials. A combination of three different panels can be used with multi-cavity forms to, for example, provide fire resistant panels on one side, insulating panels in between concrete cavities and finishing panels on the other side. Of course, the use of other combinations and/or types of materials is contemplated by the present disclosure.

Insulating construction panels interlocked with other insulating construction panels to form insulating concrete forms for casting concrete. Insulating construction panels are interlocked transversely, horizontally and vertically by a plurality of ties. The insulating construction panels are connected by regularly spaced ties in a parallel relationship to form a concrete receiving cavity. Each of the panels has a top end and a bottom end, a first end and a second end and a front end and a back end. The top end and bottom end of each panel has a plurality of alternating projections and recesses being similar in dimension. The projections and recessions on the top and bottom ends are symmetrically arranged whereby the insulating construction panels can be additionally interconnected with a like member in a bi-directional, reversible or perpendicular manner. The recesses on both the top and bottom ends contain drainage grooves extending to the back end of panel. The construction panels have regularly spaced coplanar passages extending through the panel from top end to bottom end. Insulating construction panels have an L-shaped groove on the top end and bottom end extending from the first end to the second end for the purpose of receiving a T-shaped molding which is used for corner form construction. Each tie includes a pair of elongated end plates and a spacer joined by an angular connector perpendicular to the end plates. There is also the possibility of using a tie with three end plates and 3 connectors for the purpose of constructing multi-cavity forms. The end plates and connectors of ties are inserted halfway into the top end of coplanar passages of opposite construction panels. The bottom end of coplanar passages of the next row of construction panels are then interlocked onto the remaining top half of end plates and connectors. Corner construction is reinforced by T-shaped moldings containing orifices to accept the projections of the construction panels. The T-shaped moldings fit into the L-shaped groove between the top and bottom ends of construction panels. The T-shaped moldings are inserted into a T-shaped passage in the connector and held in place with pins inserted through smaller orifices in the T-shaped molding and through the tabs on the connectors.

The invention claimed is:

1. An insulating construction panel having a top end, a bottom end, a first end, a second end, a front side and a rear side, the panel for constructing a single or multi-cavity concrete form, the panel comprising:

regularly spaced coplanar passages extending completely through the panel from the top end of the panel toward and through to the bottom end of the panel;

for each of the regularly spaced coplanar passages, an angular passage perpendicularly intersecting each coplanar passage at the top end and extending toward and through a portion of the front side and the rear side of the panel, each angular passage extending only partially through the panel from the top end toward the bottom end; and for each of the regularly spaced coplanar passages, an angular passage perpendicularly intersecting each coplanar passage at the bottom end and extending toward and through a portion of the front side and the rear side of the panel, each angular passage extending only partially through the panel from the bottom end toward the top end.

2. The insulating construction panel of claim 1, further comprising:

a plurality of alternating similarly dimensioned projections and recesses on both the top end and bottom end; and drainage grooves provided on at least one of the top end and bottom end of the panel, the drainage grooves extending from the recesses through at least one of the rear side and front side of the panel.

3. The insulating construction panel as recited in claim 2, wherein the panels are assembled such that the projections and recesses of one panel mate with corresponding recesses and projections of another panel.

4. The insulating construction panel of claim 1, further comprising:

an L-shaped groove on at least one of the top end and bottom end of the panel extending from the first end to the second end of the panel for receiving a T-shaped molding; and a plurality of recesses to receive tabs from tie connectors on at least one side of the angular passages on the top end and the bottom end of the panel.

5. The insulating construction panel of claim 4, further comprising:

an insertable tie for interlocking two or more of the insulating construction panels to construct a single or multi-cavity concrete form, the tie comprising:

two or more elongated plates, the elongated plates including horizontal center marks on an outside face of the elongated plates;

at least one angular connector, perpendicularly intersecting each of the two or more elongated plates; and at least one spacer joining the angular connectors.

6. The insulating construction panel as recited in claim 5, the tie further comprising:

T-shaped passages centrally provided through the at least one angular connector for receiving a T-shaped corner reinforcing molding; and tabs extending perpendicularly from both sides of the at least one angular connector and including a notch to receive a pin to secure the T-shape moldings corner reinforcing molding.

7. The insulating construction panel as recited in claim 6, further comprising a T-shape molding, the T-shape molding comprising:

a web with regularly spaced orifices, the web perpendicularly attached to a ribbed flange to form the T-shaped molding, wherein the T-shaped molding is dimensioned to be accepted by the T-shaped passage within angular connectors of the ties and the L-shaped groove on at least one of the top end and the bottom end of the panel; and wherein the regularly spaced orifices are dimensioned and positioned to accept projections on at least one of the top end and the bottom end of the panel.

8. The insulating construction panel as recited in claim 7, wherein the web is perpendicularly attached substantially to a center of the ribbed flange.

9. The insulating construction panel as recited in claim 5, the tie further comprising:

at least one perpendicular stopper provided on each spacer between spacer and angular connector at each end to keep panels in place; and at least one regularly spaced ring on at least one of a top and a bottom of the spacer, the at least one regularly spaced ring including openings for uniform placement of horizontal reinforcement bars.

10. The insulating construction panel as recited in claim 9, wherein the at least one regularly spaced ring is designed for easy removal of construction tools and materials.

11. The insulating construction panel as recited in claim 9, further comprising:

arched ring connectors provided between open ends of the at least one regularly spaced rings with half rounded edges for comfortable handling during installation and easy reinforcement bar insertion.

12. The insulating construction panel as recited in claim 9, further comprising:

a continuous horizontal marking along a center of the at least one spacer extending between the perpendicular stoppers to mark cutting location for splitting ties into two even halves.

13. An insulating construction panel as recited in claim 5, wherein the two or more elongated plates are insertable into the regularly spaced coplanar passages of two or more parallel arranged construction panels to maintain the panels a predetermined distance apart to form a space into which concrete can be poured, wherein the two or more elongated plates provide a suitable structure into which connectors can be driven and secured when attaching finishing materials to a face of the two or more elongated plates.

14. An insulating construction panel as recited in claim 5, wherein the two or more elongated plates comprise first and second elongated plates and wherein the tie further comprises a third elongated plate.

15. An insulating construction panel as recited in claim 14, further comprising at least one angular connector perpendicularly intersecting the third elongated plate.

16. An insulating construction panel as recited in claim 15, further comprising at least one spacer joining the at least one angular connector perpendicularly intersecting the third elongated plate and one of the first and second elongated plates.

17. The insulating construction panel of claim 1, further comprising:

a continuous horizontal marking centrally located between the top end and the bottom end of the panel and extending along the front side of the panel from the first end to the second end for marking space for convenient cutting and utility installation.

18. The insulating construction panel as recited in claim 1, wherein the insulating construction panel comprises an insulating material.

* * * * *